US006082406A

United States Patent [19]

Williamson, Jr. et al.

[11] Patent Number: 6,082,406

[45] Date of Patent: Jul. 4, 2000

[54] PNEUMATIC PILOT-OPERATED CONTROL VALVE ASSEMBLY

[75] Inventors: Felton Williamson, Jr., Harrison Twp.; John A. Kempf, Clarkston, both of Mich.

[73] Assignee: Master Pneumatic - Detroit, Inc., Sterling Heights, Mich.

[21] Appl. No.: 08/909,420

[22] Filed: Aug. 11, 1997

[51] Int. Cl.[7] ..... F15B 13/043

[52] U.S. Cl. ..... 137/627.5; 137/596.16; 137/596.18

[58] Field of Search ..... 137/596.16, 627.5, 137/596.18; 91/433, 457

[56] References Cited

U.S. PATENT DOCUMENTS

| | | | |
|---|---|---|---|
| 2,990,852 | 7/1961 | Siman et al. | 137/596.18 |
| 4,014,509 | 3/1977 | Yoshino et al. | 137/625.64 X |
| 4,068,902 | 1/1978 | Deem et al. | 137/627.5 |
| 4,265,270 | 5/1981 | Satoh | 137/505.14 X |
| 4,353,290 | 10/1982 | Hoffman et al. . | |
| 4,579,042 | 4/1986 | Neff . | |
| 4,640,309 | 2/1987 | Hoffman et al. . | |
| 4,651,625 | 3/1987 | Hoge . | |
| 4,680,441 | 7/1987 | McKendrick . | |
| 4,733,042 | 3/1988 | Nishiwaki et al. . | |
| 4,861,959 | 8/1989 | Cecil . | |
| 4,898,203 | 2/1990 | Kobelt | 137/596.16 X |
| 5,032,704 | 7/1991 | Neff et al. . | |
| 5,115,113 | 5/1992 | Miller . | |
| 5,184,535 | 2/1993 | Kimura | 137/596.16 X |
| 5,251,705 | 10/1993 | Waggoner et al. . | |
| 5,349,151 | 9/1994 | Eisbrenner et al. . | |
| 5,361,679 | 11/1994 | Foster . | |
| 5,412,172 | 5/1995 | Ichikawa et al. . | |
| 5,484,986 | 1/1996 | Fantazian et al. . | |
| 5,545,872 | 8/1996 | Nakamima et al. . | |
| 5,615,710 | 4/1997 | Sato | 137/625.64 |

*Primary Examiner*—Gerald A. Michalsky
*Attorney, Agent, or Firm*—Gifford, Krass, Groh, Sprinkle, Anderson & Citkowski, P.C.

[57] ABSTRACT

A pilot operated and pneumatically driven control valve assembly has a pair of pilot operated and pneumatically driven regulators to control the pressurization and venting of a pneumatic cylinder. The pilots of each regulator are alternately driven by a pair of normally open pilot operated valves each of which is in communication with a separate regulator to control the pressurization of that regulator. The pressure acting on the pilot of each regulator controls the flow of air through the regulator and the subsequent magnitude of the pressure within the pneumatic cylinder. Thus, varying the pressure in the pilot of the regulator varies the resulting pressure in the pneumatic cylinder in proportion to the pilot pressure. The pilot operated valves are alternately driven between open and closed positions to alternately drive the pilots of the regulators. The regulators communicate with opposed sides of a piston of a pneumatic cylinder to control the pressurization of the cylinder adjacent each side of the piston. The pneumatic cylinder may be of any type with one current application used to drive the clamp of a welding gun of an electrical resistance welder such as that used in an automotive assembly line.

3 Claims, 8 Drawing Sheets

PNEUMATIC PILOT-OPERATED CONTROL VALVE ASSEMBLY

FIELD OF THE INVENTION

This invention relates to control valves and more particularly to a pilot operated control valve assembly for pneumatic cylinders.

BACKGROUND OF THE INVENTION

Currently, three-way or four-way spool valves are used to control the pressurization and venting of pneumatic cylinders. Spool valves require extremely close tolerances and are therefore difficult to manufacture and assemble and are susceptible to becoming jammed within their associated valve bore during use. When jammed, the valve bore in the body and/or the spool valve itself may become damaged thereby necessitating repairing or replacing one or both of them.

Because of the close tolerances required for the operation of spool valves, they are difficult to assemble into their associated valve bores and are extremely intolerant of particulate contaminants and wear. When contaminants enter the associated valve bore of a spool valve, the spool valve or valve bore can become damaged which requires repairing or replacing the spool valve and/or the entire spool valve assembly. The spool valve can also become jammed within the valve bore due to contaminants which requires repairing or replacing the spool valve assembly which can be labor intensive and costly. Further, when used in an assembly line environment, failure of the spool valve assembly requires temporarily shutting down the assembly line to repair or replace the spool valve assembly which is time consuming and very costly.

One current use of a spool valve is to control the welding cylinders, in an automated system such as used in the automotive industry to drive a welding gun of an electrical resistance welder. The spool valve controls the pressurization of the drive cylinder which in turn controls the weld clamp jaws of the welding gun which, when clamped provides the weld to the workpiece in the clamp. Typically, this operation is automated and within an assembly line and thus, if the spool valve becomes jammed the jaws of the weld clamp can remain engaged with the workpiece and can destroy expensive parts, such as automotive bodies as well as other components of the assembly line. This also requires shutting down the assembly line to repair or replace the spool valve assembly and disengage the weld clamp jaws from the workpiece. Shutting down the assembly line is extremely costly and time consuming and repairing or replacing the spool valve assembly is labor intensive and therefore also very costly.

Further, the spool valve is only capable of responding to an on-off signal and does not provide a force which is proportional to an input signal and therefore does not provide a force which can be varied to vary the clamping force and subsequent welding force of the weld clamp. To perform this function with a spool valve, a pressure regulator must be added to the spool valve assembly which increases the complexity of the assembly and also its cost.

SUMMARY OF THE INVENTION

A pilot operated and pneumatically driven control valve assembly has a pair of pilot operated and pneumatically driven regulators to control the pressurization and venting of a pneumatic cylinder. The pilots of each regulator are alternately driven by a pair of normally open pilot operated valves each of which is in communication with a separate regulator to control the pressurization of that regulator. The pilot operated valves are alternately driven between open and closed positions to alternately drive the pilots of the regulators. The regulators communicate with a pneumatic cylinder adjacent opposed sides of a piston within the cylinder to control the pressurization of the cylinder adjacent each side of the piston. The pneumatic cylinder may be of any type with one current application used to drive the weld clamp of an electrical resistance welder such as that used in an automotive assembly line.

The pilot operated control valve assembly can be pneumatically driven such as by compressed air from an air compressor. The pressure of the air delivered to the pilot of a regulator controls the flow of air through the regulator and provides an output air pressure from the regulator which is proportional to the pressure at the pilot. With the inclusion of an air pressure regulator which can vary the pressure of air supplied to the regulator pilots, the output pressure of the regulators can be varied. The output of the air pressure regulator can be electronically controlled to permit remote operation and/or automated control of the regulators. Thus, the clamping pressure of the weld clamp in an electrical resistance welding gun can be varied by simply varying the pressure supplied to the pilots of the regulators. This allows the same control valve assembly and pneumatic cylinder to be used under varying conditions and with varying workpieces which require different weld clamp pressures.

The pilot operated valves and regulators do not require the extremely close tolerances required for spool valves and are thus easier to manufacture and assemble. Further, the pilot operated control valve assembly is more tolerant of contamination than a spool valve and when contaminated, the control valve assembly will merely experience a reduction in performance, not a total failure such as when a spool valve becomes jammed. Generally, the effect of contamination within the control valve assembly will be a slight reduction in clamping pressure and/or a slightly longer time required to open or close the weld clamp. In most cases, the pressurized air within the assembly will clear the assembly of contaminants after one cycle.

Objects, features and advantages of this invention include providing a pilot operated control valve assembly to control a pneumatic cylinder that is tolerant of contaminants, can be manufactured with large tolerances, can provide an output proportional to an input signal, fails gradually rather than abruptly like a spool valve when jammed, provides rapid pressurization and venting of the pneumatic cylinder, is readily adaptable to many pneumatic cylinder applications, is capable of rapid cycle times, is of relatively simple design and economical manufacture and assembly, is rugged, durable, reliable and has a long useful in-service life.

BRIEF DESCRIPTION OF THE DRAWINGS

These and other objects, features and advantages of this invention will be apparent from the following detailed description of the preferred embodiments and the best mode, appended claims and accompanying drawings in which:

DETAILED DESCRIPTION OF THE PREFERRED EMBODIMENTS

Figure 1:
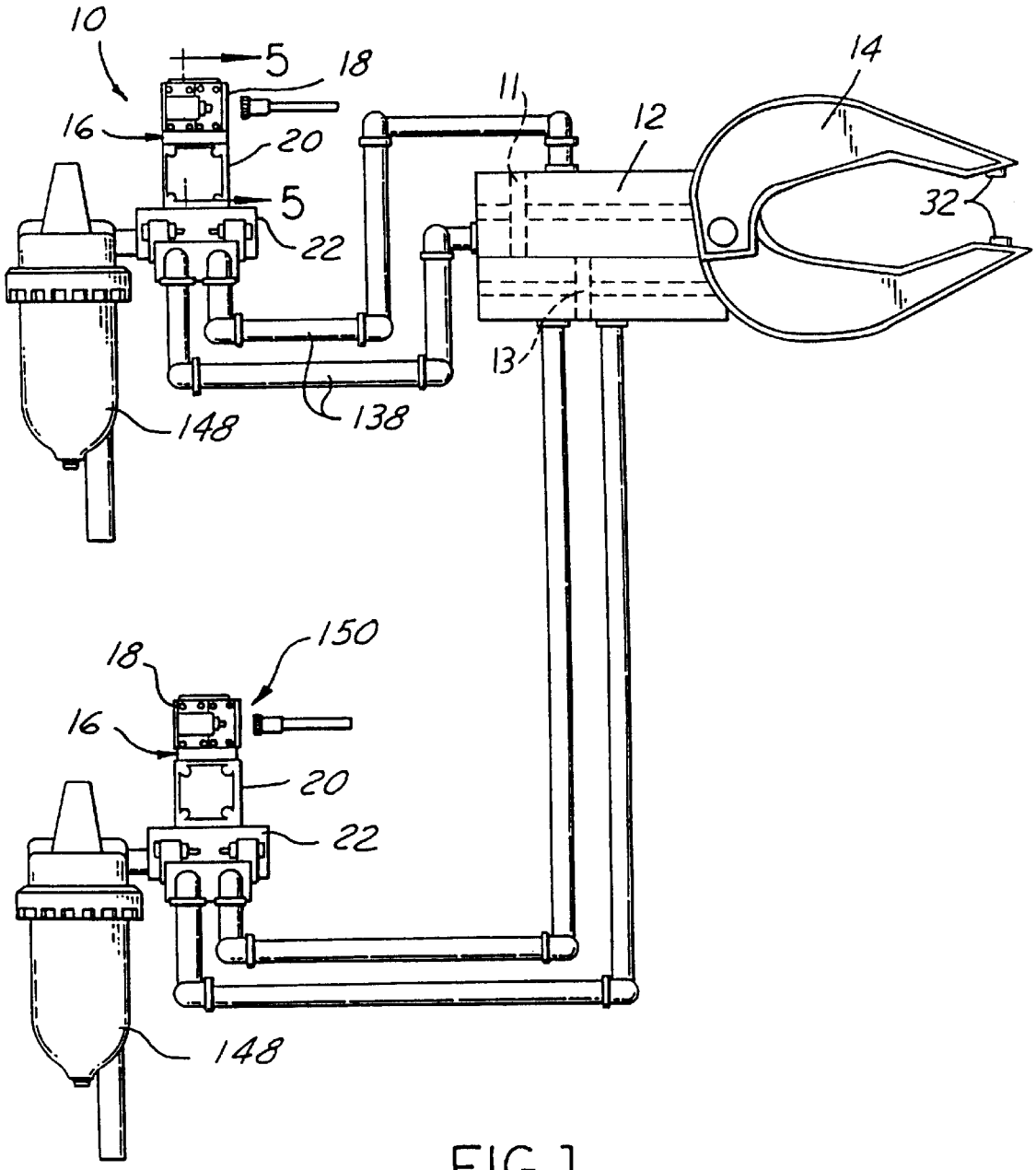
FIG. 1 is a diagrammatic view of a pair of control valve assemblies embodying this invention and used with an automotive type electrical resistance welder.
Figure 2:
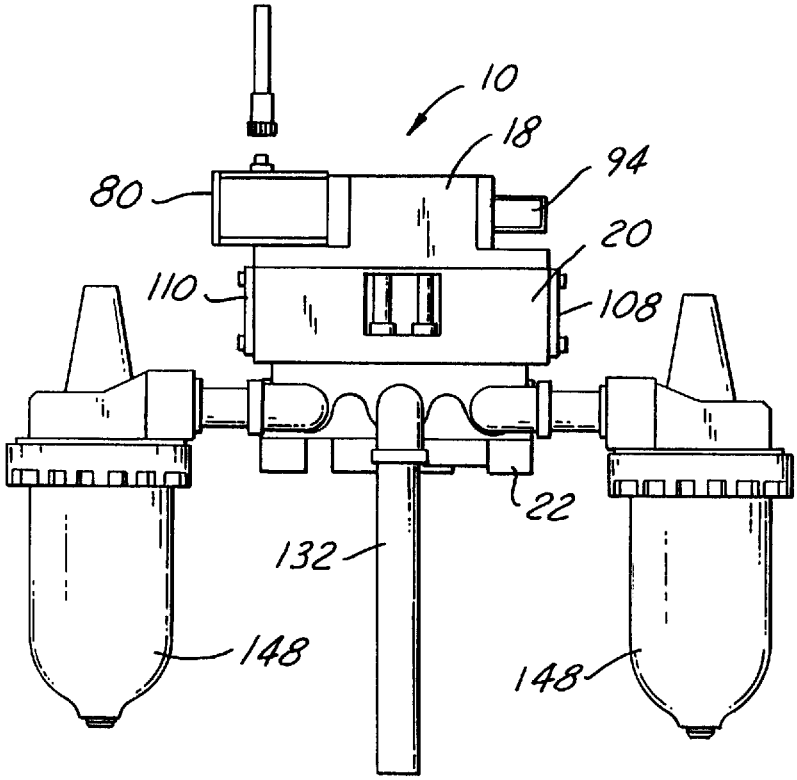
FIG. 2 is a plan view of a control valve assembly in FIG. 1 having a proportional control module.

As shown in FIGS. 1 and 2, a control valve assembly 10 is provided to control the pressurization and venting of a pneumatic cylinder 12 which can be utilized to drive a welding clamp 14 of an electrical resistance welding gun. The pneumatic cylinder 12 preferably has a pair of pistons 11, 13 therein with one piston driven to actuate the jaws of the welding clamp 14 and the other piston driven to advance and retract the welding gun.

The control valve assembly 10 is contained within a housing 16 having a head 18 and a body 20 which interfaces with a standard automotive weld cylinder manifold 22. The assembly 10 has two pilot operated regulators 24, 26 (FIG. 5) driven by a pneumatic input control signal, such as air from an air compressor, which delivers pressurized air to the pilot dome 28, 30 of each pilot operated regulator, 24, 26 respectively. When the first regulator 24 is pressurized, it pressurizes a portion of the weld cylinder 12 to provide the force urging the welding tips or electrical contacts 32 of the weld clamp 14 into engagement with the workpiece. When the second regulator 26 is pressurized, it pressurizes an opposite side of the weld cylinder 12 to open the weld clamp 14 and disengage it from the workpiece.

In use, the first regulator 24 and second regulator 26 are alternately driven such that when one of them is pressurized, the other is vented to the atmosphere. To accomplish this alternate actuation of the regulators a first pilot operated valve 34 (FIG. 6) and a second pilot operated valve 36 are provided each of which is in communication with a separate regulator, 24, 26 respectively, to control the pressurization of that regulator.

Figure 6:
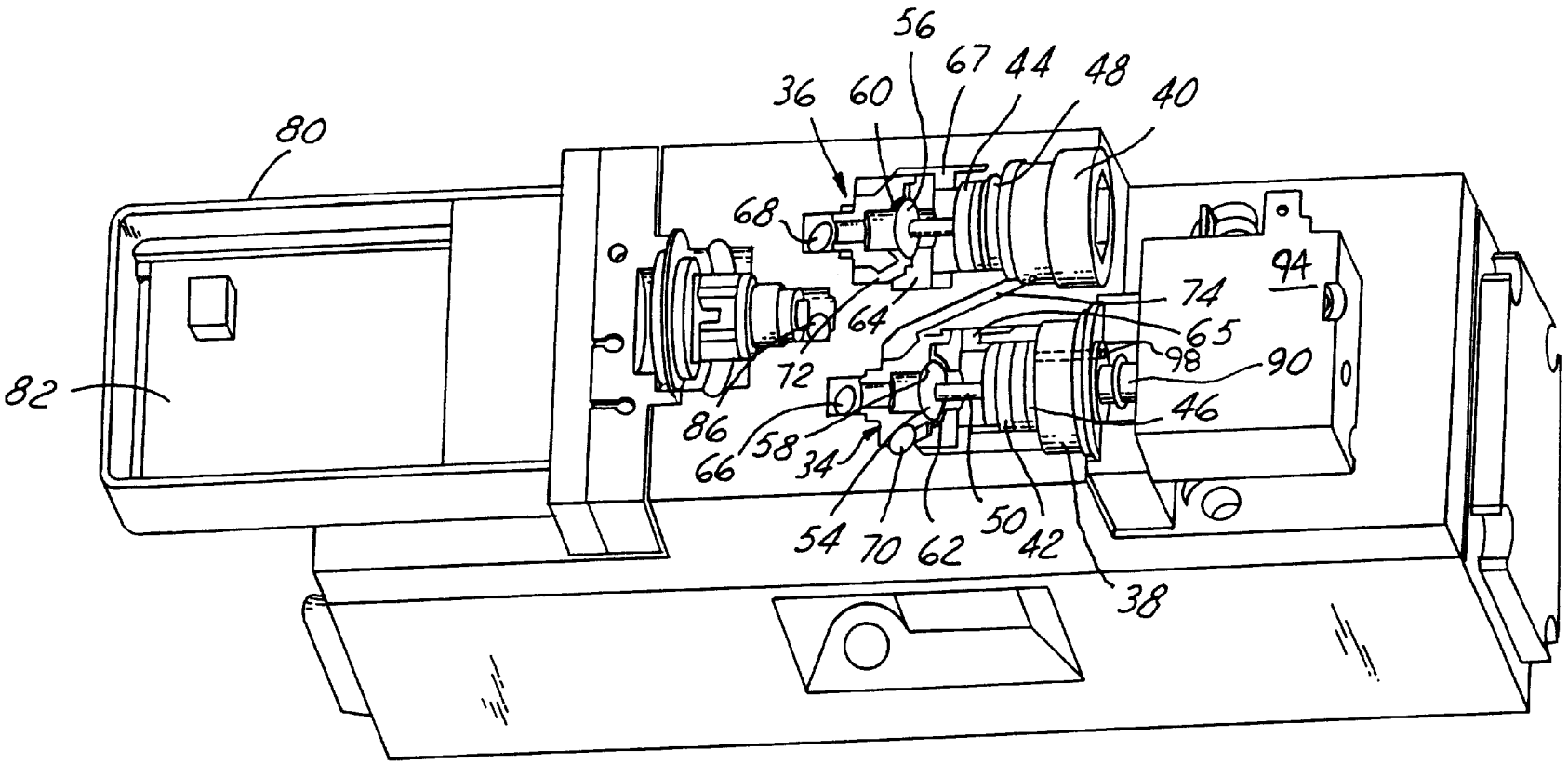
FIG. 6 is a cross sectional view taken along line 6—6 of FIG. 5.

As shown in FIG. 6, each pilot operated valve 34, 36 has a pilot dome 38, 40, a piston 42, 44 having one face 46, 48 in communication with the pilot dome 38, 40, a valve stem 50, 52 operably associated with the piston 42, 44 and a valve head 54, 56 attached to the valve stem 50, 52 and moveable between a first position on an upper seat 58, 60 and a second position on a lower seat 62, 64. When pressurized air is within the pilot dome 38, 40 and acting on the face 46, 48 of the piston 42, 44, the valve head 54, 56 is moved against its upper seat 58, 60 and a vent passage 65, 67 is opened to allow the pilot dome 28, 30 of the associated regulator 24, 26 to be vented. Each valve head 54, 56 is biased (such as by a spring, not shown) to its second position on its lower seat 62, 64 and in this position, pressurized air supplied to a valve inlet 66, 68 of each valve 34, 36 is communicated with the associated regulator pilot dome 28, 30 through a supply passage 70, 72. The valve inlet 66 of the first pilot operated valve 34 is also communicated with the pilot dome 40 of the second pilot operated valve 36 through a connecting passage 74 to pressurize that pilot dome 40 when the valve head 54 is adjacent its lower seat 62.

To provide an output air pressure which can be readily and remotely varied, a proportional air control module 80 is provided. The control module 80 (FIGS. 5 and 6) has an electronic card 82 which has a variable analog control signal of between 0 to 10 volts or 4 to 20 ma to control output pressure of a pilot-operated pressure supply regulator 84 downstream of the control module 80. The supply regulator 84 functions to control the pressure of the air supplied to the pilot operated valves 34, 36 which selectively communicate that air with the regulator pilot domes 28, 30. Alternatively, the system can be used without a proportional air control module 80 and the supply regulator 84 can be manually adjustable to vary its output pressure. As another alternative, a pair of supply pressure regulators may be provided with each either manually or electronically controlled. In this embodiment, each regulator communicates with a separate pilot operated valve 34, 36 to separately control the pressure of compressed air delivered to each pilot operated valve 34, 36.

Figure 5:
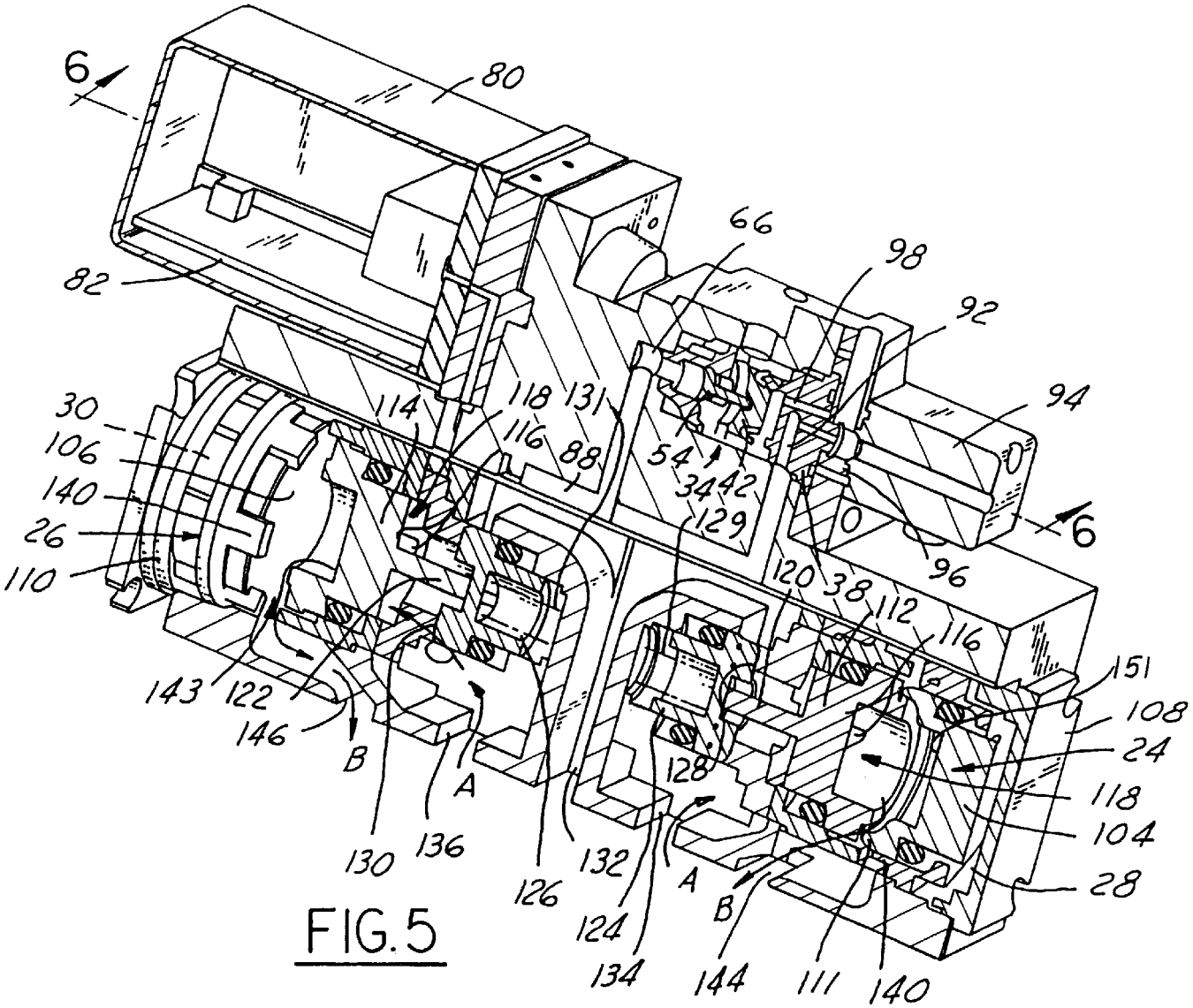
FIG. 5 is a cross sectional view taken along line 5—5 of FIG. 1.

As best seen in FIG. 5, the supply regulator 84 has an outlet 86 in communication with the valve inlet 66, 68 of each pilot operated valve 34, 36 through a passage 88 between them. The supply regulator 84 also communicates with a valve 90 via a passage 92 through the pilot dome 38. The valve 90 is driven between open and closed positions by a solenoid 94 to selectively permit air in the passage 92 to flow into a chamber 96 defined between the pilot dome 38 and solenoid 94. Air in the chamber 96 flows into the pilot dome 38 through an opening 98 to act on the piston 42. The solenoid driven valve 90 controls pressurization of the pilot dome 38 which thereby controls the movement of the valve head 54 to its first and second positions. Movement of the valve head 54 controls pressurization and venting of the pilot dome 28 of the first regulator 24 and also controls pressurization of the pilot dome 40 of the second pilot operated valve 36 which, in turn, controls movement of its associated valve head 56. Movement of this valve head 56 controls the pressurization and venting of the pilot dome 30 of the second regulator 26. Thus, the function of the control valve assembly 10 is dictated by the solenoid driven valve 90 which controls the pilot operated valves 34, 36 which in turn, alternately actuate the pilot operated regulators 24, 26.

As shown in FIG. 5, the pilot operated regulators 24, 26 are each received in the body 20 of the housing 16 and through the manifold 22 are in communication with the pneumatic cylinder 12 and preferably with opposed chambers in the cylinder 12 adjacent opposed faces of a piston therein. With this configuration, the regulators 24, 26 can control pressurization of the cylinder 12 to drive the piston in opposed directions to both open and close the jaws of the weld clamp 14.

Each regulator 24, 26 has a main valve 104, 106 which defines in part its pilot dome 28, 30 and is slidably received for reciprocation in an end cap 108, 110 of the housing 16 to vary the axial size of the pilot dome 28, 30. An annular, raised rim 111 of the main valve 104, 106 bears on a plunger body 112, 114 to displace the plunger body 112, 114 when the pilot dome 28, 30 is pressurized and the main valve 104, 106 is displaced towards the plunger body 112, 114. The plunger body 112, 114 has a plurality of guide fibs 116 to control its axial movement and openings 118 between the fins 116 and through the plunger body 112, 114. Each plunger body 112, 114 also has an axially extending stem 120, 122 which bears on a valve head 124, 126 which is biased to a normally closed position on a valve seat 128, 130 by a spring 129, 131. In its closed position each valve head 124, 126 prevents supply air, which is delivered to the body 20 through a supply passage 132 in communication with each of the valve heads 124, 126, from exiting through an outlet 134, 136 and entering the pneumatic cylinder 12. Preferably, supply lines 138 connected to the manifold 22 communicate each outlet 134, 136 with the pneumatic cylinder 12.

When a valve head 124, 126 is acted on by the stem 120, 122 of the plunger body 112, 114 and moved to its open position, compressed air in the supply passage 132 can flow beyond the valve head 124, 126, through the outlet 134, 136 downstream of the valve head 124, 126 and into the pneumatic cylinder 12. Air which flows through one outlet 134 pressurizes one chamber in the pneumatic cylinder 12 to displace the piston and cause the weld clamp 14 to close. Air which flows through the other outlet 136 pressurizes the opposite chamber of the pneumatic cylinder 12 to return the piston and thereby open the weld clamp 14. As noted earlier, the pilot operated regulators 24, 26 are alternately driven to ensure that only one valve head 124 or 126 is open at one time so that only one chamber in the pneumatic cylinder 12 is pressurized at one time.

Each end cap 108, 110 has stand-off feet 140 extending therefrom and constructed to engage the plunger body 112, 114 when the pilot dome 28, 30 is vented and the main valve 104, 106, plunger body 112, 114 and valve head 124, 126 return towards their original positions. When the plunger body 112, 114 engages the stand-off feet 140 the main valve 104, 106 separates from the plunger body 112, 114 providing a gap 142, 143 between them through which air in the pneumatic cylinder 12 can flow to the atmosphere through a vent passage 144, 146 along flow path A-B as shown by the arrows in FIG. 5. This vent passage 144, 146 remains open until the pilot dome 28, 30 is again pressurized and the main valve 104, 106 is displaced into engagement with the plunger body 112, 114. The vented air preferably flows through the manifold 22 and into filtered exhaust modules 148 connected to the manifold 22.

Figure 3:
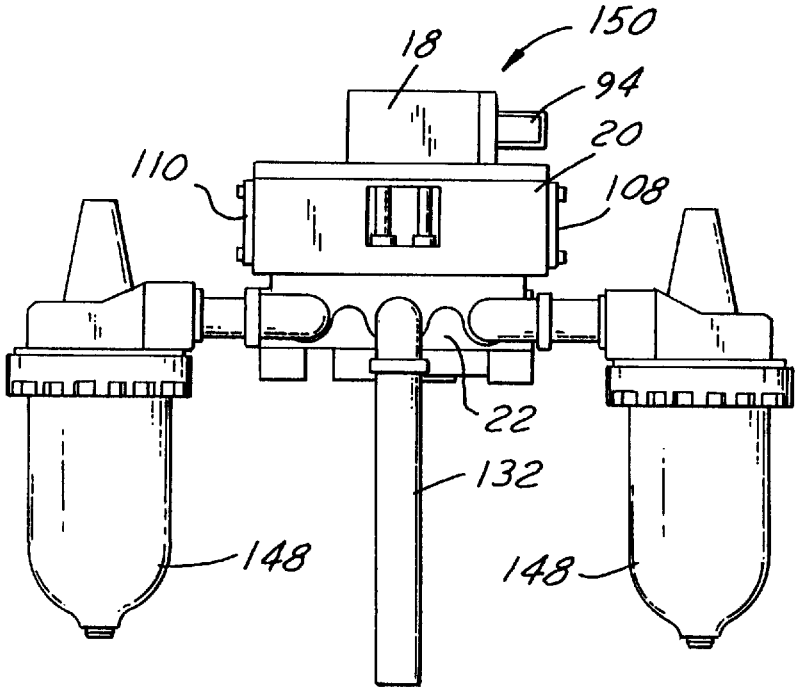
FIG. 3 is a plan view of the other control valve assembly of FIG. 1.
Figure 7:
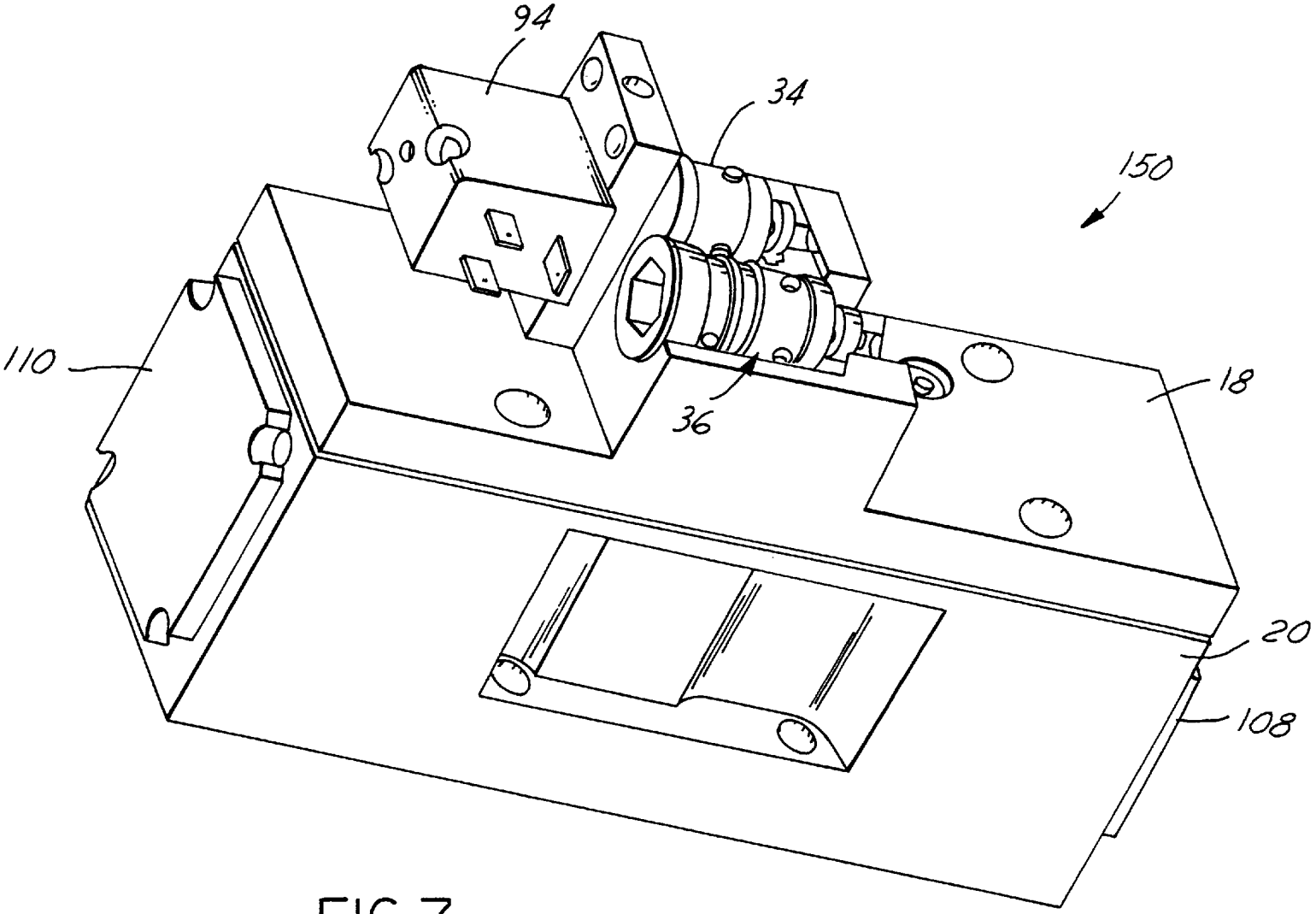
FIG. 7 is a perspective view of the control valve assembly of FIG. 3.

As shown in FIGS. 1, 3 and 7, a modified control valve assembly 150 can also be used in applications where the output pressure does not need to be variable. In this configuration, the control valve assembly 150 does not have a control module 80 or a supply regulator 84 and supply air from the air supply flows directly to each valve inlet 66, 68 and to the solenoid driven valve 90. This control valve assembly 150 functions in substantially the same manner as the previously described version except that its output is essentially constant because an essentially constant pressure is delivered to the pilot domes of its regulators. As shown in FIGS. 1 and 3, this control valve assembly 150 is used to actuate a pneumatic cylinder to advance and retract the welding gun which carries the weld clamp 14 and is useful in many other pneumatic cylinder applications where similar movement of a piston, work arm or the like is desired.

Operation of the Pilot Operated Valves

Figure 4A:
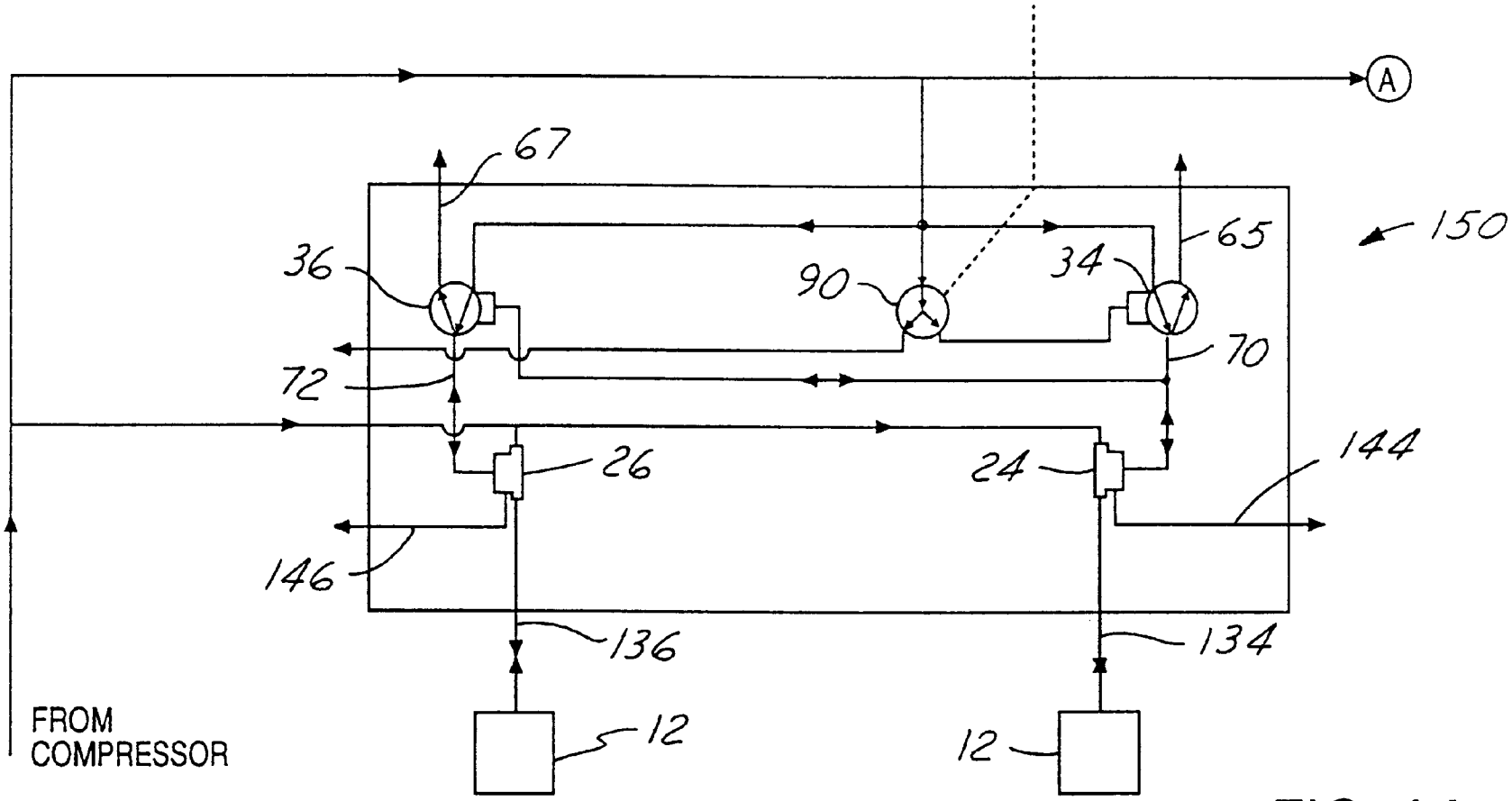
FIG. 4A is a circuit diagram of the control valve assembly of FIG. 3.
Figure 4B:
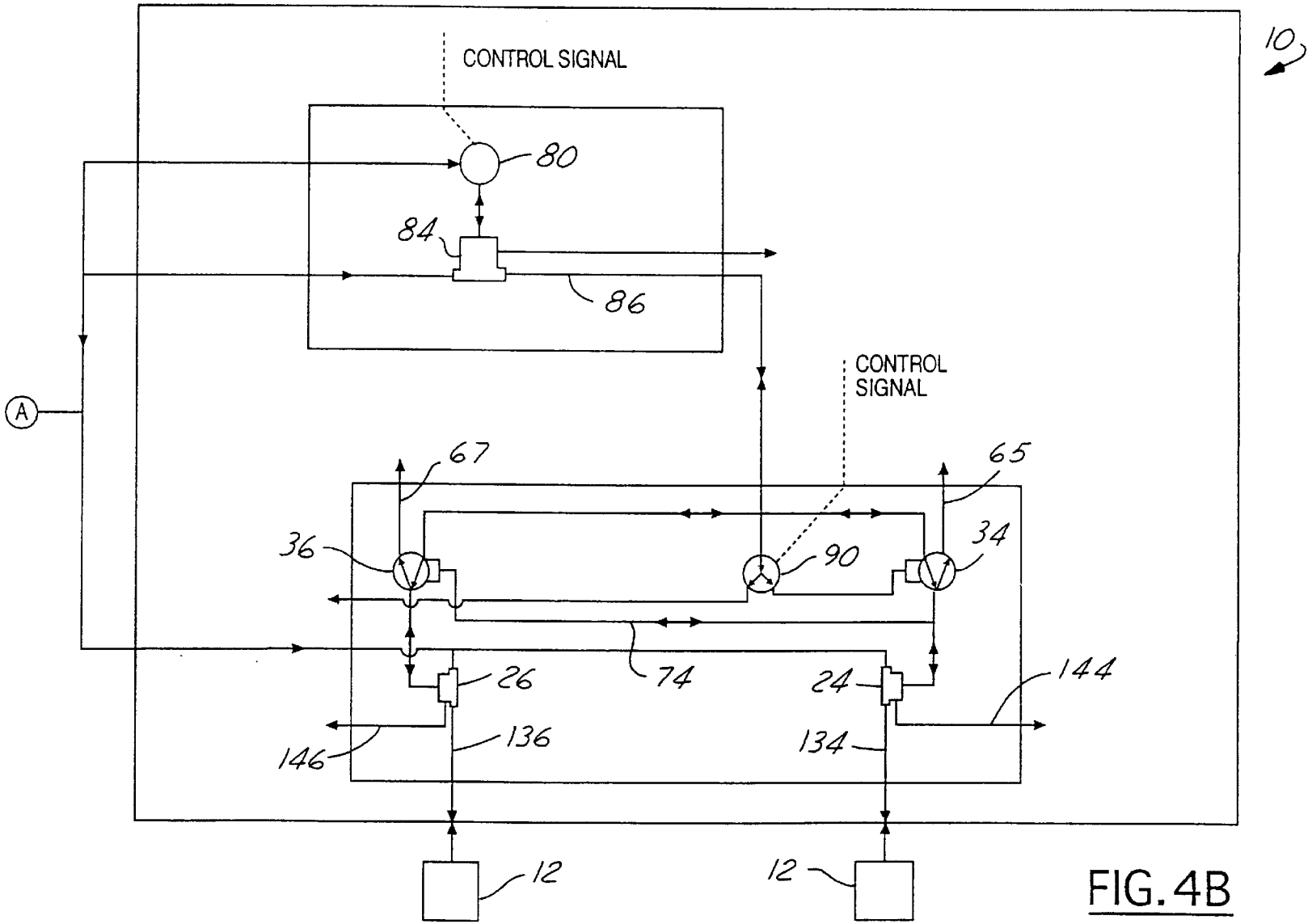
FIG. 4B is a circuit diagram of the control valve assembly of FIG. 2.

An analog control signal on the order of between 0 to 10 volts or 4 to 20 ma is provided to the electronic card 82 of the proportion air control module 80. The control module 80 provides an output air pressure of the supply regulator 84 of between about 0 and 100 psi which is proportional to the electric input signal it receives. As shown in FIGS. 4A and 4B, the output of the supply regulator 84 flows to the valve inlet 66, 68 of each pilot operated valve 34, 36, and also to the solenoid 94 which drives the first pilot operated valve 34. The air signal provided to the inlet 68 of the second pilot operated valve 36, which is normally open, closes that valve head 56 on its lower valve seat 64 whereupon that input air flows through the passage 72 adjacent the valve head 56 and into the pilot dome 30 of the second regulator 26, to actuate that regulator 26 and supply air under pressure to the portion of the cylinder 12 which opens the weld clamp 14.

A digital electric control signal is supplied to the solenoid 94 to open the normally closed solenoid driven valve 90 and allow the input air from the supply regulator 84 to flow through the solenoid driven valve 90 and into the pilot dome 38 of the first pilot operated valve 34 to act on the piston 42 therein and close the valve head 54 on its upper seat 58. With the valve 34 in this closed position, the input signal from the supply regulator 84 is blocked and the vent passage 65 is open. The air within the pilot dome 28 of the first regulator 24, which closes the weld clamp 14, is vented back through the valve 34 between the valve head 54 and the piston 42 and through the vent passage 65 to the atmosphere. As described above, this allows the main valve 104, plunger body 112 and valve head 124 to move towards the end cap 108 and eventually provide the gap 142 between the plunger body 112 and main valve 104 to open the vent passage 144 and vent to atmosphere that portion of the pneumatic cylinder 12 along flow path A-B of FIG. 5. Thus, pressure is supplied to one side of the cylinder 12 to open the weld clamp 14 and the opposite side of the cylinder 12 which closes the weld clamp 14 is vented to the atmosphere when the first 34 and second 36 pilot operated valves are in the above described position.

To reverse the positions of the pilot operated valves 34, 36, the solenoid driven valve 90 is closed to prevent the pressurization of the pilot dome 38 of the first pilot operated valve 34. The compressed air at the valve inlet 66 moves the valve head 54 to its lower seat 62 thereby closing the vent passage 65, and allowing the compressed air from the supply regulator 84 to flow through that valve 34 and to the pilot dome 28 of the first regulator 24 which closes the weld clamp 14. With the valve 34 in this position, a portion of the output of the supply regulator 84 is also communicated to the pilot dome 40 of the second pilot operated valve 36 through the connecting passage 74 to supply air under pressure therein acting on its piston 44 to move its valve head 56 onto its upper seat 60 thereby preventing the compressed air in the valve inlet 68 from flowing to the pilot dome 30 of the second regulator 26. This opens the vent passage 67 in the valve 36 allowing the pilot dome 30 of the second regulator 26 to vent to the atmosphere and thereby opens the vent passage 144 to vent one side of the pneumatic cylinder 12 (along flow path A-B in FIG. 5) to avoid interfering with the force provided to close the weld clamp 14.

Operation of the Pilot Operated Regulators

Each regulator 24, 26 functions in the same manner but in alternate relationship as driven by the pilot operated valves 34, 36 previously described. Thus, the description of only one of the regulators 24 is necessary.

Referring again to FIGS. 4 and 5, compressed air from the air compressor is supplied through the supply passage 132 which branches to communicate with the valve head 124, 126 of each of the pilot operated regulators 24, 26 which are normally closed to prevent the air from flowing therethrough. When the air pressure is supplied to the pilot dome 28 of the first regulator 24 from the first pilot operated valve 34 as previously described, the main valve 104 is displaced which causes displacement of the plunger body 112 which bears on the valve head 124 to open it. When the valve 124 is open, the supply air flows therethrough and through the outlet 134 to pressurize the side of the cylinder 12 which closes the weld clamp 14.

The valve head 124 remains open (displaced from the valve seat 128) until the sum of the spring force and the air pressure downstream of the valve head 124 and acting on the interior face 151 of the main valve 104 is greater than the pressure within the pilot dome 28 whereupon the valve head 124 will close on the valve seat 128 to maintain the desired pressure in that portion of the cylinder 12. A change in either the pressure within the pilot dome 28 or the pressure downstream of the valve head 124 results in a pressure differential within the regulator 24 which is readily and dynamically responsive to balance the forces therein and maintain the output pressure to the cylinder 12 as a function of the pilot dome 28 pressure.

For example, if the pressure in the cylinder 12 increases, that pressure, which acts on the interior face 151 of the main valve 104 will displace the main valve 104 towards the end cap 108. The main valve 104 will separate from the plunger body 112 thereby opening the vent passage 144 to relieve the increased pressure downstream of the regulator 24 to maintain the desired pressure in the cylinder 12 as a function of the pressure in the pilot dome 28. The vent passage 144 will remain open until the forces acting on the main valve 104 cause it to again bear on the plunger body 112. Similarly, if the pressure supplied to the pilot dome 28 is increased, the main valve 104 will be displaced away from the end cap 108 causing the plunger body 112 to displace the valve head 124 from its valve seat 128 and permit supply air to flow through the outlet port 134. The valve head 124 remains open until the pressure downstream of the valve head 124 and the spring force are equal to or slightly greater than the pilot dome pressure 28. Thus, the regulators 24, 26 provide dynamic control of the pressure supplied to the cylinder 12 as a function of the pilot dome pressure to maintain the desired pressure within the cylinder 12.

When the first pilot operated valve 34 changes position, the pilot dome 28 is vented to the atmosphere. The force of the spring 129 acting on the valve 124, as well as the pressure of the air acting on the interior face 151 of the main valve 104 displaces the main valve 104 to decrease the size of the pilot dome 28. The valve 124 closes the supply passage 132 to prevent pressurizing the portion of the cylinder 12 which closes the weld clamp 14. The stand-off feet 140 provided in the end cap 108 prevent continued axial displacement of the plunger body 112. The main valve 104 continues to be displaced thereby separating from the plunger body 112 and providing the gap 142 between them allowing air within the pneumatic cylinder 12 to vent back through the outlet 134, through the plunger body openings 118 and through the gap 142 between the plunger body 112 and the main valve 104 to a vent passage 144 open to atmosphere (along flow path A-B of FIG. 5). The vent passage 144 is closed when the pilot dome 28 is again pressurized and the main valve 104 is displaced until it bears on the plunger body 112.

Because the regulators 24, 26 are alternately driven when the first regulator 24 is vented to the atmosphere, the pilot dome 30 of the second regulator 26 is pressurized to open its valve 126 and permit the supply air to pressurize the associated portion of the cylinder 12 to open the weld clamp 14. When the state of each pilot operated valve 34, 36 is changed, the pilot dome 28 of the first regulator 24 is pressurized to open its valve 124 and close the weld clamp 14 and the second regulator 26 is vented to the atmosphere.

Figure 8:
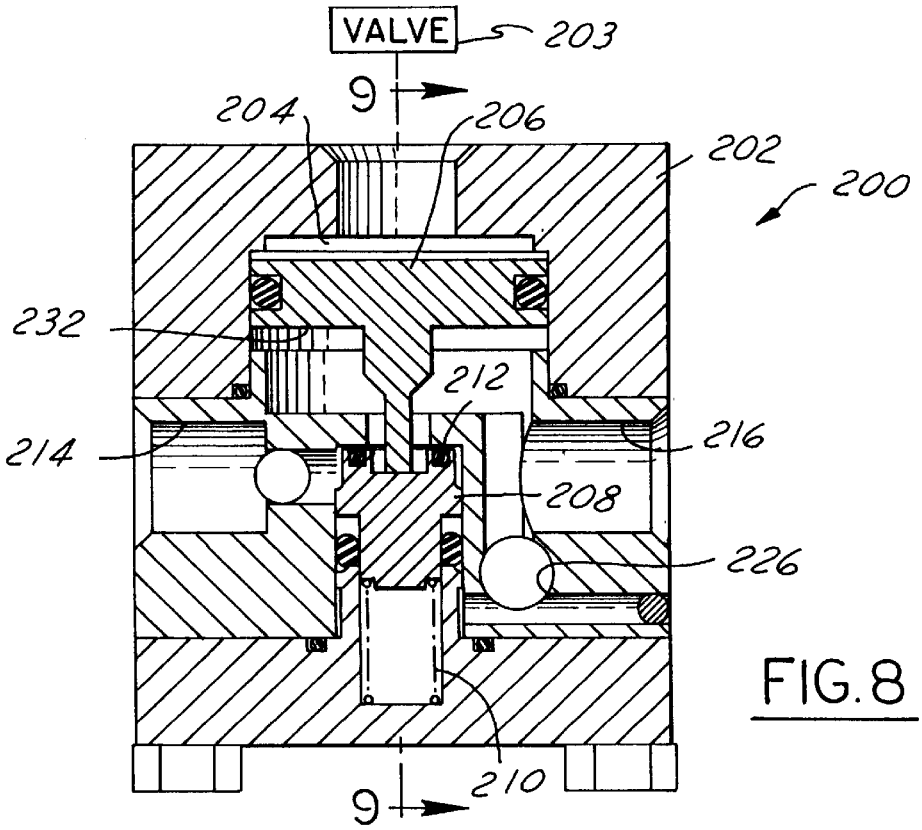
FIG. 8 is a cross sectional view of a regulator according to a second embodiment of the invention.
Figure 9:
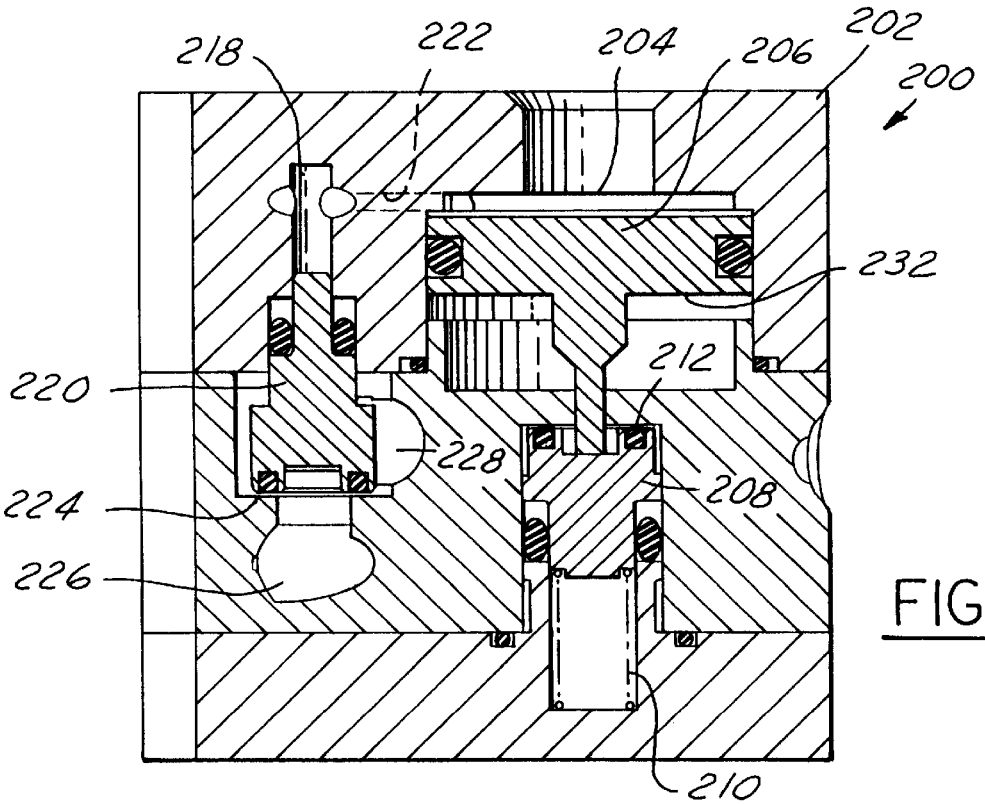
FIG. 9 is a cross sectional view taken along line 9—9 of FIG. 8.

The pilot operated regulators 24, 26 are shown in a common housing 16, but they may be separated with each disposed adjacent its associated side of the weld cylinder 12 or in some other desired orientation. Similarly, in an alternate embodiment of this invention, as shown in FIGS. 8 and 9, an individual regulator 200 can be disposed in a separate housing 202 downstream of a control valve 203 which controls the delivery of pressurized air to the pilot dome 204 of the regulator 200. In this embodiment, the pressure in the pilot dome 204 acts directly on the main valve plunger body 206 to displace a poppet valve 208 which is yieldably biased by a spring 210 to a closed position on a valve seat 212 to prevent flow of pressurized air from a supply passage 214 to an outlet port 216 downstream of the poppet valve 208. The pressurized air in the pilot dome 204 adjacent the plunger body 206 is communicated with a separate pilot chamber 218 adjacent to a poppet vent valve 220 through a connecting passage 222. The poppet vent valve 220 is closeable on a valve seat 224 to selectively communicate a passage 226, which at its other end communicates with the outlet port 216, with a vent passage 228 downstream of the poppet vent valve 220. Thus, the forces acting on the poppet vent valve 220 are the pressure of the air in the pilot chamber 218 and the pressure of the air at the outlet port 216 of the regulator 200.

Operation of the Second Embodiment Regulator

When pressurized air is delivered to the pilot dome 204 of the regulator 200 and also to the pilot chamber 218 of the poppet vent valve 220 via the connecting passage 222, the plunger body 206 is displaced thereby displacing the poppet valve 208 to permit the flow of pressurized air from the supply passage 214 through the outlet port 216. The pressure of air adjacent the outlet port 216 is communicated with the face 232 of the plunger body 206 opposite the pilot dome 204 and in combination with the force of the spring 210 acting on the poppet valve 208, opposes the force of the pressurized air in the pilot dome 204 to control movement of the poppet valve 208. The pressure of the air adjacent the outlet port 216 is also communicated with the poppet vent valve 220 via the passage 226 and acts on the poppet vent valve 220 in opposition to the pressurized air within its pilot chamber 218 and when greater than this force, displaces the poppet vent valve 220 opening the vent passage 228 and reducing the pressure at the outlet port 216. As in the first embodiment, the regulator 200 controls when pressurized air is delivered through the outlet port 216 and is also dynamically responsive to control the pressure at the outlet port 216 and hence, within the pneumatic cylinder 12. The poppet valve 208 will close on the valve seat 212 to prevent flow through the outlet port 216 when the pressure at the outlet port 216 and the force of the spring 210 are equal to or slightly greater than the air pressure within the pilot dome 204.

The pilot driven pneumatic control valve assembly 10 provides an output which can be readily varied by varying the output pressure of the supply regulator 84 (preferably via control module 80) to vary the pressure of air supplied to the pilot domes 28, 30 of each regulator 24, 26 and thereby control the clamping force of the weld clamp 14. Thus, the regulators 24, 26 and 200 function to control both when pressurized air is delivered to the pneumatic cylinder 12 and the pressure at which that air is delivered to the cylinder 12. The vent passages can also be made somewhat large thereby permitting exhaust flow equal to or greater than the primary or pressurizing flow. The system is more tolerant of contamination than spool valves and failure occurs as a gradual performance degradation rather than sudden catastrophic failure such as when a spool valve becomes jammed. Further, it should be noted that the pneumatic control valve assembly 10 can be used in any application wherein rapid pressurization and venting of a cylinder or the like is desired. For instance, as shown in FIGS. 1, 3 and 7, another valve assembly 150 can be used to advance and retract the welding clamp 14 in addition to opening and closing it. Because the output for this action does not need to be varied like the clamping force does, this valve assembly does not have a control module 80 or supply regulator 84.

What is claimed is:

1. A valve assembly for delivering a supply flow of pneumatic air from a supply of pressurized air, said valve comprising:

a housing having a supply passage, an outlet passage, and an exhaust passage, said supply passage receiving supply pressure from the supply of pressurized air, said housing further having a dome passage for communicating a flow of pilot pressure from a supply of pilot pressure;

a valve head mounted in said housing and biased to a closed position against a valve seat by a biasing member;

a cylindrical main valve member and a plunger body slidably mounted in a bore of said housing, said main valve member and said plunger body movable in said bore to move said valve head to open said supply passage in response to pilot pressure in said dome passage and communicate supply pressure from said supply passage to said outlet passage and to an interior face of said main valve, said main valve slidable away from said plunger body to open said exhaust passage when a sum of said biasing force of said biasing member and said supply pressure on said interior surface of said main valve is greater than said pilot pressure in said dome passage.

2. The valve assembly of claim 1 further comprises a dome at least one stand-off foot extending outwardly in a bore to engage said plunger body to provide an exhaust gap between said main valve and said plunger body for communicating said supply pressure to said exhaust passage when said main valve is moved to open said exhaust passage.

3. The valve assembly of claim 2, wherein said plunger body has a stem extending outwardly to engage said valve head.

* * * * *

UNITED STATES PATENT AND TRADEMARK OFFICE

CERTIFICATE OF CORRECTION

PATENT NO. : 6,082,406
DATED : July 4, 2000
INVENTOR(S) : Felton Williamson, Jr.

It is certified that error appears in the above-identified patent and that said Letters Patent is hereby corrected as shown below:

Column 4,
Line 63 - Replace "fibs" with --fins--

Column 5,
Line 57 - Replace "Operation of the Pilot Operated Valves" with --OPERATION OF THE POILOT OPRERATED VALVES-- in bold and centered Column 6,
Line 52 - Replace "Operation of the Pilot Operated Regulators" with --OPERATION OF THE OPERATED REGULATORS -- in bold and centered Column 7,
Line 57 - After "driven" insert --,--

Column 8,
Line 24 - Replace "Operations of the Second Embodiment Regulator" with "OPERATION OF THE EMBODIMENT REGULATOR" in bold and centered Signed and Sealed this Tenth Day of July, 2001

Nicholas P. Godici

*Attest:*

NICHOLAS P. GODICI
*Acting Director of the United States Patent and Trademark Office*

*Attesting Officer*